US008028475B2

(12) United States Patent
Sigmund et al.

(10) Patent No.: US 8,028,475 B2
(45) Date of Patent: Oct. 4, 2011

(54) HIGHLY VENTILATED SOFFIT WITH OBSCURED VENTILATION OPENINGS

(75) Inventors: John L. Sigmund, Holland, OH (US); Thomas C. Gilbert, Clarklake, MI (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 12/360,206

(22) Filed: Jan. 27, 2009

(65) Prior Publication Data

US 2009/0126286 A1 May 21, 2009

Related U.S. Application Data

(60) Division of application No. 10/983,984, filed on Nov. 8, 2004, now Pat. No. 7,594,362, which is a continuation-in-part of application No. 10/428,554, filed on May 2, 2003, now Pat. No. 6,941,707.

(51) Int. Cl.
*E04B 7/18* (2006.01)

(52) U.S. Cl. ..... 52/95; 52/302.1; 52/537

(58) Field of Classification Search ..... 52/95, 96, 52/302.1, 536, 537, 539, 558, 310, 73, 74, 52/630; D25/123, 125; 454/260
See application file for complete search history.

(56) References Cited

U.S. PATENT DOCUMENTS 764,989 A * 7/1904 Chester ..... 52/450
849,427 A 4/1907 Rude
1,029,864 A 6/1912 Glodsmith
1,259,914 A * 3/1918 Seward et al. ..... 52/553
1,728,934 A 9/1929 Hogenson
2,934,934 A 5/1960 Berliner
3,159,943 A 12/1964 Sugar et al.
3,185,070 A * 5/1965 Smith ..... 454/365
3,195,699 A 7/1965 Johnston
3,246,436 A 4/1966 Roush
3,289,380 A 12/1966 Charniga, Jr.
3,417,519 A 12/1966 Hitter
3,496,691 A * 2/1970 Seaburg et al. ..... 52/630
3,496,694 A 2/1970 Hicks et al.
3,555,762 A 1/1971 Costanzo
4,048,960 A 9/1977 Barnidge et al.
4,091,743 A 5/1978 Lemon (Continued)

OTHER PUBLICATIONS

Alside "Charter Oak" soffit sample and description, web page, visited Jul. 16, 2002. USA.

(Continued)

*Primary Examiner* — Robert Canfield
*Assistant Examiner* — Matthew J Smith
(74) *Attorney, Agent, or Firm* — Duane Morris LLP

(57) ABSTRACT

A ventilating component for a building, particularly a ventilating soffit, provides a high ratio of ventilation flow area to component coverage area. A sheet in a plane of coverage has a spaced-channel configuration, or alternatively a terraced configuration. Ventilation openings are placed in the connecting webs between the upper and lower levels, especially in sidewalls of elongated channels that open as slots on the exposed side of the soffit. These connecting webs are oriented at an acute angle relative to the coverage plane. In a channel arrangement the webs can be shaped to block direct view of the side walls. The acute angle precludes, or at least foreshortens, a view of the webs that contain the ventilation openings. The ventilation aspects are concealed while permitting a high ratio of flow area to coverage area.

7 Claims, 6 Drawing Sheets

U.S. PATENT DOCUMENTS

| | | | | | |
|---|---|---|---|---|---|
| 4,102,106 | A | | 7/1978 | Golder et al. | |
| 4,188,762 | A | | 2/1980 | Tellman | |
| 4,251,970 | A | | 2/1981 | Home | |
| 4,263,752 | A | | 4/1981 | Jungbluth | |
| 4,545,291 | A | * | 10/1985 | Kutsch et al. | 454/365 |
| 4,607,753 | A | | 8/1986 | Radek | |
| 4,665,675 | A | | 5/1987 | Kelly | |
| 4,695,033 | A | | 9/1987 | Imaeda | |
| 4,870,798 | A | | 10/1989 | Richter | |
| 4,930,287 | A | | 6/1990 | Volk et al. | |
| 4,986,051 | A | | 1/1991 | Meyer et al. | |
| 5,016,415 | A | | 5/1991 | Kellis | |
| 5,022,207 | A | | 6/1991 | Hartnett | |
| 5,167,104 | A | | 12/1992 | Alvarado | |
| 5,172,527 | A | | 12/1992 | Ault | |
| 5,195,283 | A | | 3/1993 | MacLeod et al. | |
| 5,243,793 | A | | 9/1993 | MacLeod et al. | |
| 5,292,281 | A | | 3/1994 | Butler | |
| 5,303,525 | A | | 4/1994 | Magee | |
| 5,417,028 | A | | 5/1995 | Meyer | |
| 5,507,126 | A | | 4/1996 | Wu | |
| 5,551,204 | A | | 9/1996 | Mayrand | |
| 5,657,585 | A | | 8/1997 | Zaccagni | |
| 5,706,618 | A | * | 1/1998 | Pratt | 52/199 |
| 5,711,117 | A | | 1/1998 | Zaccagni et al. | |
| 5,718,086 | A | | 2/1998 | Dunn | |
| 5,791,985 | A | | 8/1998 | Schiedegger et al. | |
| 5,799,446 | A | | 9/1998 | Tamlyn | |
| 5,809,731 | A | | 9/1998 | Reiss | |
| 5,881,502 | A | | 3/1999 | Tamlyn | |
| 5,937,592 | A | | 8/1999 | Tamlyn | |
| 5,946,876 | A | | 9/1999 | Grace, Sr. et al. | |
| 5,947,816 | A | | 9/1999 | Schiedegger et al. | |
| 5,950,375 | A | | 9/1999 | Zaccagni | |
| 5,956,914 | A | | 9/1999 | Williamson | |
| 6,026,616 | A | | 2/2000 | Gibson | |
| 6,134,855 | A | | 10/2000 | Beck | |
| 6,145,255 | A | | 11/2000 | Allaster | |
| 6,151,854 | A | | 11/2000 | Gutjahr | |
| 6,164,467 | A | | 12/2000 | DePottey et al. | |
| 6,185,899 | B1 | | 2/2001 | De Niet | |
| 6,223,488 | B1 | | 5/2001 | Pelfrey et al. | |
| 6,354,045 | B1 | | 3/2002 | Boone et al. | |
| 6,415,599 | B1 | | 7/2002 | Ausdenmoore et al. | |
| 6,474,032 | B1 | | 11/2002 | Wynn | |
| 6,516,577 | B2 | | 2/2003 | Pelfrey et al. | |
| D523,564 | S | | 6/2006 | Gilbert | |
| D523,968 | S | | 6/2006 | Gilbert | |
| 7,137,224 | B2 | | 11/2006 | Rasmussen | |
| 7,594,362 | B2 | * | 9/2009 | Sigmund et al. | 52/96 |

OTHER PUBLICATIONS

Crane Plastics "Premium Point" soffit sample and description, web page, 2001. USA.

Heartland "Woodhaven" soffit sample and description, web page, visited Jul. 16, 2002. USA.

Louisiana Pacific "I-Span" soffit sample and description, web page, 2000. USA.

* cited by examiner

HIGHLY VENTILATED SOFFIT WITH OBSCURED VENTILATION OPENINGS

This application is a Division of U.S. patent application Ser. No. 10/983,984, filed Nov. 8, 2004, now U.S. Pat. No. 7,594,362, which is a Continuation in Part of Ser. No. 10/428,554, filed May 2, 2003, now U.S. Pat. No. 6,941,707, both of which applications are expressly incorporated by reference herein in their entireties.

BACKGROUND OF THE INVENTION

The invention relates to building components having through openings to facilitate ventilation.

Substantially planar panel components that can be mounted horizontally as soffit panels under the eaves of a building overhang, are provided with ventilation openings located on internal surfaces disposed behind elongated slots. These internal surfaces are arranged at a low angle of incidence or are entirely obscured from view in a configuration with a dovetail or keystone shape. According to another aspect, the ventilation openings account for a high proportion of the surface area of the surfaces behind the slots, preferably exceeding the area of the slots, thereby providing a high cross sectional area open to air flow.

The components can be formed webs or sheets and preferably are flat on an exposed side but for the elongated slots. The web or sheet material is diverted from the flat plane at preferably parallel regularly-spaced elongated ridges. Each ridge forms a channel, generally U-shaped in cross section, opening as a narrow slot at the surface on the flat plane.

Ventilation openings are formed through walls of the channel disposed behind the slots. The ventilation openings thereby are at least obscured and can be made wholly invisible by placing the openings laterally outside a line of sight through the slot. In one embodiment the openings are exclusively made in laterally diverging dovetail or keystone shaped sidewalls. Although the openings are concealed, the openings can have a total ventilation cross sectional area exceeding the cross sectional area of the slot.

PRIOR ART

In construction of various roof shapes as well as other structures, it is desirable to provide an overhang at which the roof projects beyond a vertical wall under the roof, namely an eaves. The roof could be horizontal or inclined. The overhanging or projecting part is normally boxed-in by facing sheets. The typically horizontal planar face on the underside of the projection is known as a soffit.

A traditional soffit is constructed of wooden planks installed either parallel to the direction of elongation of the soffit or perpendicular thereto. Some cutting and fitting is needed for installing wooden soffits. Even in the relatively protected area under the eaves, wooden soffits need periodic maintenance, especially painting. It is desirable to face the exterior surfaces of buildings with materials that are inexpensive, easily and quickly installed, and characterized by low maintenance over a long useful life.

Modern building siding materials often are made of manufactured materials that simulate traditional wood materials. Some exemplary materials include aluminum sheet material and extruded or injection-molded polymer materials such as polyvinyl chloride, polypropylene or the like. Such materials, often used for siding, advantageously can be used to form a horizontal soffit panel and/or associated vertical fascia panels adjacent to the soffit. As with siding, the soffit covering panels can be large integral units that are cut to size, or separate incremental pieces that engage or lap one another and together face the surface.

In building structures that have unheated attics with ridge vents, gable end vents, roof vents or fans, it is advantageous if the soffits provide free flowing air inlets. This establishes air flow to moderate attic temperatures and to eliminate certain condensation problems. For wooden soffit constructions, relatively large circular or rectangular openings are provided for mounting louvers or screens. In artificial siding materials such as polymer panels for soffits, typically ventilation is provided by fenestrating the soffit panels with a pattern of small openings such as holes or slots. Preferably such openings are made as part of the forming process, e.g., during injection molding of polymers. For extrusion processes or for aluminum or other thin sheets, openings can be stamped or formed using embossing rollers.

The air flow resistance of a soffit structure is related in part to the total cross sectional area provided for the passage of air and in part to the configuration of openings that make up the total area, normally the sum of the cross sectional areas of a plurality of individual openings. A relatively continuously covered soffit structure is preferred over an open eaves, for example to achieve a finished appearance and to exclude unwanted insects and animals. At the same time, unencumbered air flow is desirable. Other things being equal, providing relatively lower flow resistance requires larger and more obviously-apparent openings in the soffit. Aesthetically, and for purposes of excluding insects and the like, larger or visible openings in a structure are generally not desirable. Effort have been made to resolve these competing considerations by making decorative opening patterns. Decorative patterns deliberately are made visible.

Some examples of perforate and/or foraminous soffit panels for ventilation are found in U.S. Pat. Nos. 5,718,086—Dunn; U.S. Pat. No. 5,937,592—Tamlyn; U.S. Pat. No. 5,950,375—Zaccagni; U.S. Pat. No. 6,026,616—Gibson; and, U.S. Pat. No. 6145255—Allaster. These include variations in the material that is used to permit a ventilation flow, differences as to whether the perforate material extends over the whole soffit area or only localized vents, variations in the shapes of openings, such as holes versus slots, hole covering variations such as louvers, screens or openings with backing materials such as fiber batts and screens, and other features.

It is generally the case that vents and/or holes for allowing air flow through the soffit are readily visible, which might be expected in view of the need to provide substantially unobstructed air flows paths of a some cross sectional area related to the desired air flow conditions. It would be advantageous to provide less visible ventilation openings, while allowing air to pass freely.

SUMMARY OF THE INVENTION

It is an object of the invention to provided a soffit structure that is optimized for manufactured materials such as extruded polymer or formed sheet metal material, but appears to be a traditional wooden plank facing material, and has substantially concealed ventilation openings.

According to an aspect of the invention, a soffit is constructed from abutted jointed sheets having intermediate folds from the plane of an exposed surface. The folds each define a channel extending along a plane of the surface and having a depth direction perpendicular to the surface. The channels formed by these folds have bottoms and side walls. Ventilation openings are provided in the side walls, and the bottoms can be continuous sheets. The channels present slots in the exposed surface, and the ventilation openings in the side walls are substantially concealed.

According to another aspect, the folds and channels are formed so that the bottom of the channel has a lateral dimension that is wider than the width of the slot that enters the channel. The side walls containing the ventilation openings are inclined away from one another and the edges of the slot, such that the channel can have a dovetail shape in cross section.

A line of sight into the slot is oriented at least at a low incidence angle relative to the side walls containing the ventilation openings, and in certain arrangements can wholly conceal the ventilation openings from any viewing perspective. Preferably, the angles and dimensions are chosen at least so that the ventilation openings in the side and/or bottom walls of the channel are not along a direct line of sight or are seen at a low incidence angle. This result can be achieved in alternative ways according to the invention, concealing the ventilation openings particularly from the distances at which the soffit is normally seen by a viewer on the ground. The slots can be made in manufactured materials that are inexpensive an convenient to install. The slots opening into the ventilation channels can be configured to resemble slots between traditional wooden planks such as tongue and groove wooden facings in which bevels slots delineate individual planks. The sum of the cross sectional areas of the openings, namely the total area of all the flow paths for ventilation air, is very substantial compared to alternatives in which the openings are apparent on the surface as ventilation openings.

The ventilating component of the invention, particularly a ventilating soffit for external building applications, provides a high ratio of ventilation flow area to component coverage area. The sheet in a plane of coverage has a spaced-channel configuration, or alternatively a terraced configuration. Ventilation openings are placed in the connecting webs between the upper and lower levels, especially in sidewalls of elongated channels that open as slots on the exposed side of the soffit. These connecting webs are oriented at an acute angle relative to the coverage plane. In a channel arrangement the webs can be shaped to block direct view of the side walls. The acute angle precludes, or at least foreshortens, a view of the webs that contain the ventilation openings. The ventilation aspects are concealed while permitting a high ratio of flow area to coverage area.

A number of further objects and aspects will be apparent from the following examples and the associated discussion of variations of which the invention is capable.

BRIEF DESCRIPTION OF THE DRAWINGS

The foregoing features and advantages of the invention, as well as other aspects and routine extensions of the invention, are apparent from the following detailed description of examples and preferred embodiments, to be considered together with the accompanying drawings, wherein the same reference numbers have been used throughout to refer to the same functioning parts, and wherein.

DETAILED DESCRIPTION

Figure 1:
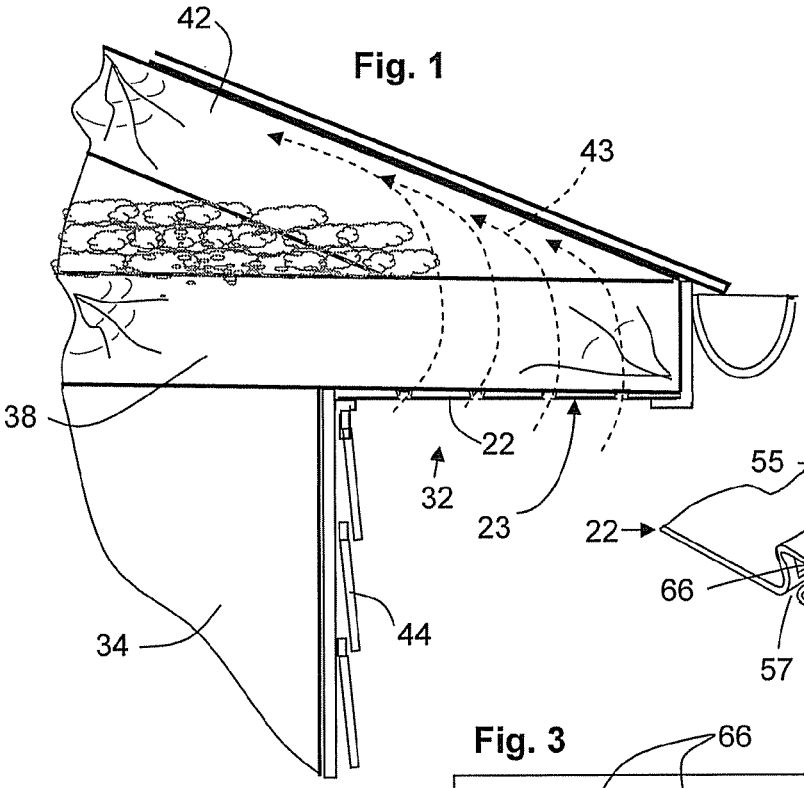
FIG. 1 is a partial section view showing a building eaves having a ventilating soffit panel according to the invention.

A number of exemplary embodiments of the invention are described herein with reference to the drawings. These embodiments are examples intended to demonstrate aspects of the invention in different forms or separately. Not all the aspects are required in all embodiments of the invention, and the illustrated embodiments should be regarded as exemplary rather than limiting.

In this description, terms denoting relative directions and orientations such as "lower," "upper," "horizontal," "vertical," "above," "below," "up," "down," "top" and "bottom" should be construed to refer to the orientation as then being described or as shown in the drawing under discussion. Terms concerning attachments, coupling and the like, such as "connected" and "interconnected," refer to a relationship wherein elements are integral parts of a whole, or are secured or attached to one another either directly or indirectly through intervening structures, as well as both movable or rigid attachments or relationships, unless expressly described otherwise or as apparent in view of the described functions of such elements. The reference numeral 22 is used below interchangeably to designate a ventilating component, soffit panel, plurality of panels, component panel, integral component and modular panel.

The invention is described substantially with reference to the underside facing of a building eaves structure. It should be appreciated that the invention is fully applicable to other uses in which similar needs for ventilation capacity and surface coverage are encountered.

Referring to FIG. 1, an inventive ventilating component 22 is demonstrated on the eaves 32 of a structure 34. In this conventional example of a building eaves, spaced joists 36 project beyond the plane of the exterior wall 38 (one joist being shown). Likewise, spaced roof rafters 42 slope upwardly from the ends of the joints to a roof ridge (not shown). It is desirable to permit air to flow through the area under the eaves, an air flow 43 shown generally by broken lines, through the attic space between an insulated ceiling and the underside of the roof sheathing, up toward a ridge vent or perhaps toward a gable vent or roof fan (not shown).

In order to permit air flow 43 in the direction shown, the structure that boxes in the underside of the eaves 32 comprises a soffit panel 23 that has ventilation openings, i.e., through holes. According to an inventive aspect, the particular openings are arranged to maximize the total cross sectional area of flow paths provided through soffit component 22, while substantially concealing the ventilation provisions.

The ventilating soffit for the building structure comprises one or more panels 23 made of a sheet material extending over the required coverage area. The panel 23 used in a given installation might be dimensioned or cut to size so as to fit exactly in the space under the eaves 32 that needs coverage. Preferably, however, a plurality of panels 23 are used, each being a modular component that covers an incremental area, and is assembled with other similar modular component panels in a manner much the same as how siding panels 44 are used to cover exterior walls.

Figure 2:
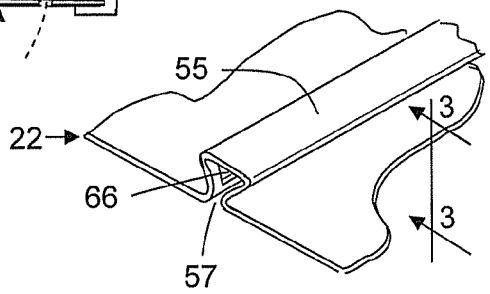
FIG. 2 is a cut away perspective view showing a dovetail shape for one of the ridges or channels in the soffit panel of FIG. 1, seen from the top or side opposite from the exposed side.

As shown in the partial perspective view of FIG. 2, one or more of the component panels 23 has a channel 55 formed in the sheet material. One or more channels 55 can be provided in each modular panel 23, preferably two or more channels 55 being provided. In this embodiment the channel opens as an elongated slot 57 on one side of the panel 23 (the outwardly facing underside in FIGS. 1 and 2). The channels 55 have channel side walls 62 and a channel bottom 64, which projects on a side of the panel 23 opposite from the exposed side, namely upwardly in the orientation shown in FIGS. 1 and 2. Of course other orientations are possible.

Figure 3:
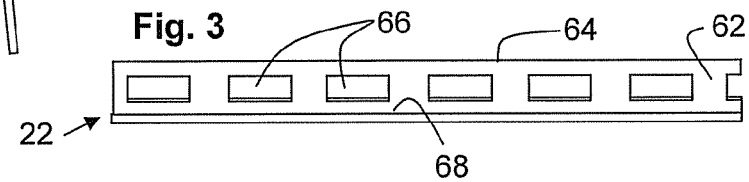
FIG. 3 is an elevation view showing the openings in one or both sides of the ridge shown in FIG. 2.

In order to allow a flow of ventilation air, the channel 55 as shown in FIG. 2 and more clearly in FIG. 3 has at least one ventilation opening 66, and preferably an array of ventilation openings 66. Inasmuch as the ventilation opening(s) 66 are provided in the walls of the channel 55, the ventilation openings 66 are not readily seen from the exposed side (from below in FIG. 1). However, the entry into each channel 55 is visible as the elongated slot 57. The ventilation openings 66 are concealed from view, from the exposed side, inside the channel 55 and behind the associated elongated slot 57 opening on the exposed surface of panel 23.

Figure 4:
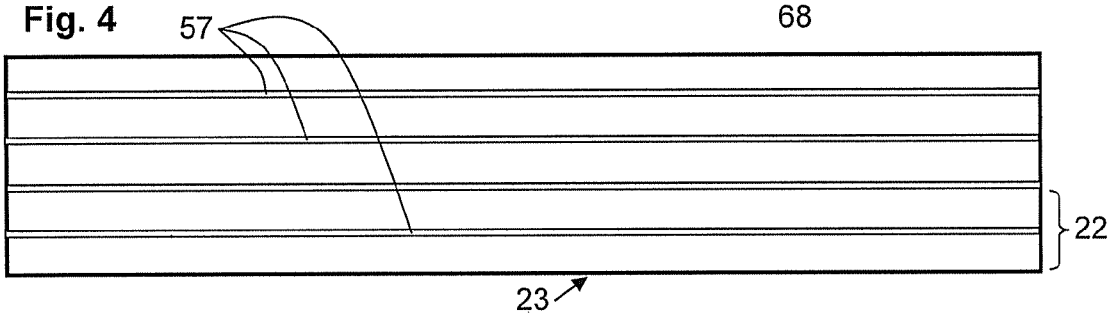
FIG. 4 is a plan view from the exposed side (from below in FIG. 1), showing one possible orientation for the elongation of the ridges.
Figure 5:
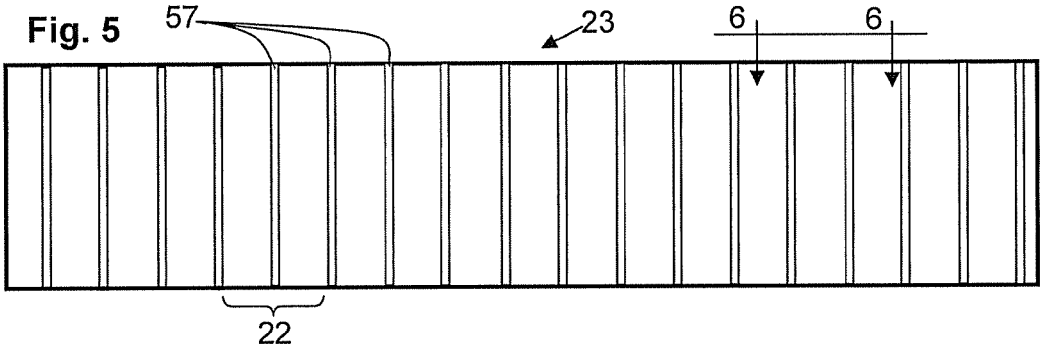
FIG. 5 is a plane view as in FIG. 4, wherein the ridges have a different orientation of elongation.

FIG. 4 shows that the channels and their slots 57 can be parallel, evenly spaced and longitudinally elongated. FIG. 5 shows that the slots 57 can be laterally elongated. In FIG. 5, the channels and slots but also parallel and evenly spaced. It should be appreciated that the structure could comprise channels and slots that are oriented in other specific directions, such as obliquely. The channels and slots can be unevenly spaced. Instead of straight lines, the channels can follow curves, zig-zag forms or other configurations. Rather than being presented simply as slots in an otherwise flat surface, the channels 55 and their opening slots 57 can be incorporated into more complicated decorative configurations.

For purposes of simplicity and without limitation, the invention is described with respect to an embodiment having evenly spaced parallel channels 55. This configuration is advantageous because the spaces between the channel slots 57 appear similar to traditional wooden planks, and the elongated slots 57 leading into the channels 55 can be made to resemble relatively narrow construction gaps between planks, such as a tongue and groove construction in which the edges of the planks are beveled and present spaced edges that are represented by the edges of the slots 57. The simulated planks can run longitudinally or laterally as in FIGS. 4 and 5.

Preferably, the overall eaves coverage or soffit is constructed of a number of discrete integral ventilation components 22, each of which simulates two or more planks. The ventilation components 22 have complementary inter-engaging joint structures on their opposite ends, whereby the components can be joined to adjacent abutting components in a manner similar to installation of aluminum or polymer siding materials on vertical building walls, which have joints between abutting ends is a given course as well as joints to affix adjacent courses vertically.

FIGS. 2 and 3 show an example in which ventilation openings 66 are provided exclusively in the side walls 62 of a channel 55 that is raised from the plane of the exposed side of the soffit and has a dovetail shape in cross section. Specific structures are shown in greater detail in FIGS. 6-11. The ventilating component 22 has at least one and preferably a plurality of channels 55. One or more of the channels, and preferably all of the channels, has an array of regularly spaced ventilation openings 66. In FIG. 3 the openings 66 are rectangular, but any shape is possible. In FIG. 3, it is apparent that the sum of the cross sectional areas of the openings over one of the channel side walls is over half of the available area of the side walls. Assuming that both opposite sidewall have comparable openings as are shown in FIG. 3, then the cross sectional area provided for flow is not substantially limited by the sidewall openings, because the sum of their cross sectional areas is relatively large in comparison to the cross sectional area of the elongated slot at the opening into the channel. The openings 66 can be at least as large and preferably the sum of their areas is larger, than the area of a corresponding length along a slot 57.

Ventilation openings 66 can be provided in any part of the channels 55, i.e., in one or the other or both of the side walls 62 and/or in the bottom 64 of the channel 55. The ventilation openings 66 preferably are disposed in at least one of the spaced channel side walls 62 and most preferably are disposed in both opposite side walls, whereas the channel bottom 64 preferably is substantially continuous (i.e., has no ventilation openings). This arrangement is effective to conceal or deemphasize the ventilation aspect of the soffit panels 23 while at the same time allowing a substantial cross sectional area of openings for such flow.

According to an inventive aspect, at least a part of at least one of said side walls 63 containing said ventilation openings 66 is inclined in a direction away from the elongated slot 57, i.e., away from the opposite side wall in a direction proceeding away from the slot 57. This can be represented in a dovetail or keystone cross section as shown in FIGS. 6 and 7, or in other specific shapes.

It is possible, for example, that only one of the side walls 62 could be inclined in this way. However preferably, both spaced channel side walls 62 contain ventilation openings 66 and both spaced channel side walls 62 are inclined away from one another and away from the edges at which they meet the flat outer face of the ventilation component 22 and define slot 57.

Figure 6:
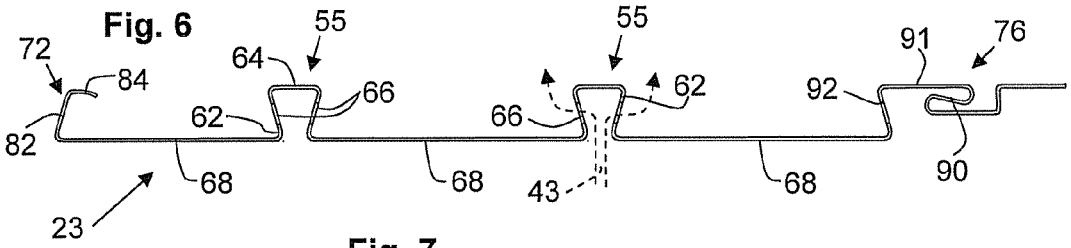
FIG. 6 is an end view of a soffit panel component, for example along lines 6-6 in FIG. 4.

In the arrangement in FIG. 6, the channel bottom 64 is substantially flat, giving the channels a dovetail shape in cross section. The channel bottom 64 could have other shapes (not shown), such as convexly or concavely rounded, formed into a vee or inverted vee, etc.

Figure 7:
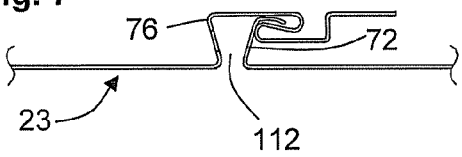
FIG. 7 is a partial section as in FIG. 6, including a joint between abutting component panels.

The illustrated panel 23 including ventilation components 22 as in FIGS. 6 and 7 are coupled to form an array or composite of panels that defines a plane over the coverage area. A plurality of the channels 55 having ventilation openings 66 are regularly spaced over the coverage area. The bottom webs 64 of the channels are parallel to and spaced from the main body plane of the webs 68 of material extending from one channel 57 to the next, across the exposed side of ventilation component 22.

Figure 9:
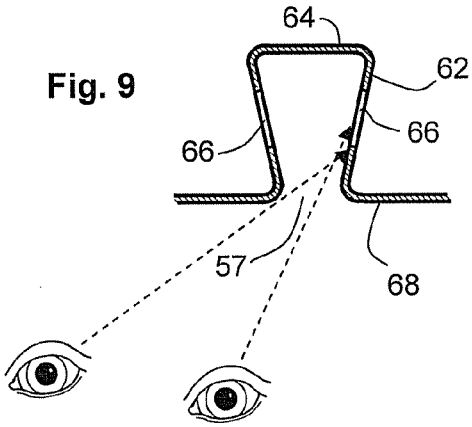
FIG. 9 is a partial section view demonstrating certain sight lines for an embodiment as in FIG. 6.

In FIGS. 6, 7 and 9, the side walls 62 containing the ventilation openings 66 meet at acute angles with both the bottom 64 of their associated channel and with the web 68 extending to the next successive channel. It is not strictly necessary to regard the narrower dimension between successive side walls (e.g., bottom 64) as defining the channel (i.e., a relatively narrow channel extending away from the exposed side or upwardly in FIG. 1.). The same relationship of side walls to plane walls is found with respect to the broader dimension between successive side walls 62, i.e., considering webs 68 as the bottoms of broader upwardly opening "channels." In each case, the bottoms of the channels as thereby defined (webs 64 or 68) are parallel to the coverage plane, and the side walls 62 of the channel each join integrally at an acute angle with an adjacent said channel bottom (64 or 68) and with an adjacent said portion (68 or 64, respectively) extending between the channels. It is an aspect of this configuration that the ventilation openings 66 are at least relatively concealed from view and can be entirely concealed, due to the relationship or perspective at which one might view from a distance away from the plane of the soffit panel 23.

Figure 8:
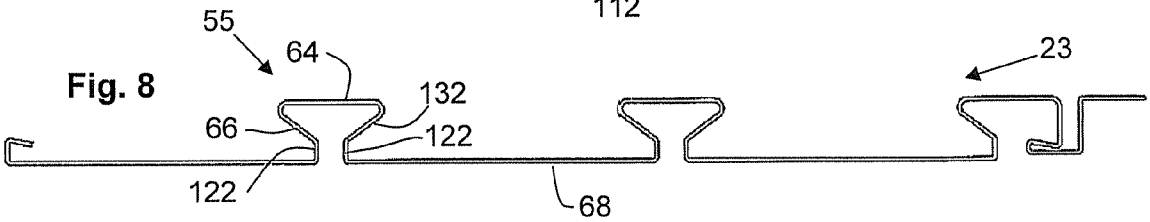
FIG. 8 is an end corresponding to FIG. 6, and showing a different contour.

FIGS. 6-8 show some exemplary variations in channel shape and also show advantageous joint configurations whereby a soffit panel 23 can be joined to an adjacent identical component, each covering part of the coverage area. As shown, each ventilating component comprises complementary opposite joint structures 72, 76, at opposite edges of the soffit panel 23, whereby said ventilating component is attachable to another such ventilating component by engaging respective complementary opposite joint structures 72, 76 thereof.

FIG. 6, for example, shows an exemplary set of joint structures, formed by bending or otherwise forming the web of material that makes up soffit panel 23. The joint structures 72, 76 fit together as shown in FIG. 7. On a first end, a hook joint 72 is formed with a side wall 82 that is oriented at the same angle relative to the exposed side web 68 as one of the intermediate channel side walls 62. The extreme end 84 of the hook is bent back, over the adjacent body web 68 of the component. On the opposite or receiver joint side 76, an S-bend 90 forms a shape complementary to the hook 72, being arranged to capture the end 84 of the hook between bends of an S-shape. The S-shape is disposed at the same level above from the exposed side 68 as the hook end 84. The S-shape is carried on a web 91 that has a strip parallel to the exposed side 68, which strip is placed to resemble the bottom of a channel 55. Across the S-bend 90, a nailing edge is provided at the same level as web 91. As shown in FIG. 7, in the assembled state the nailing edge is covered over.

The web or strip 91 that is placed at the height of a channel bottom 64 is joined by a side wall 92, at the appropriate spacing and also at the same acute angle, relative to the adjacent web 68 on the exposed side leading to the next successive 55 channel. As a result, when two such components are assembled as shown in FIG. 7, the assembled joint structures 72, 76 form channels 112 that appear the same as the intermediate channels 55 formed integrally at positions spaced inwardly away from the joints 72, 76 at the edges of soffit panel 23.

Therefore, as shown in FIGS. 6-8, the soffit panels 23 have complementary opposite joint structures 72, 76 including joint walls 82, 92 that are inclined away from a joint gap. The joint walls and the joint gap as assembled are placed and shaped substantially to resemble the channels 55 otherwise provided, particularly as formed integrally in the sheet material of the soffit panels 23.

Figure 10:
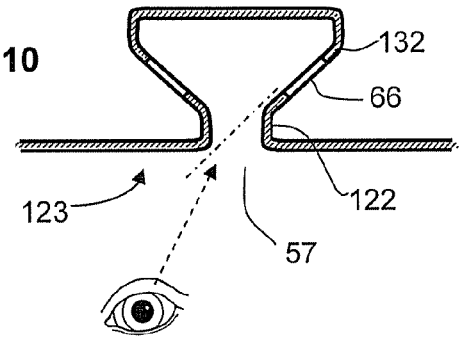
FIG. 10 is a partial section view for comparison with FIG. 6, using the contour in FIG. 8.

Referring to FIGS. 8-10, the side walls of each channel 55 can contain entry portions 122 adjacent to the elongated slot 57 that are not coplanar with the portions 132 of the side walls that contain the ventilation openings 66. As in FIGS. 8 and 10, the entry portions 122 of the side walls can be made to form a narrow vestibule between parallel portions 122 across the slot 57, at least at some point between the exposed face of web 68 and the ventilation openings 66. In the examples shown, the side wall entry portions 122 are substantially parallel to one another and form a narrow rectilinear slot entry zone over a short distance immediately adjacent to the slot 57. The parts 132 of the respective side walls containing the ventilation openings 66 are spaced away from the slot by the entry portions 122 and are aligned at a more diverging angle than the entry portions, which in the example are at right angles to the plane of webs 68 in FIGS. 8 and 10.

The specific orientation of the side walls relative to a line of sight 140, shown in dotted lines in FIGS. 9 and 10, has an effect on the extent to which the ventilation openings 66 are concealed. Often, the attic space of a building is dark, at least within the eaves, and it is already difficult to distinguish ventilation openings 66 without back lighting seen through the slots 57. In FIG. 9, the side walls are at a relatively high acute angle relative to the panel plane (this example being about 70° to the panel plane). Even so, the viewer's line of sight from the slot to the ventilation opening is limited and is at a low angle of incidence relative to the side wall containing the ventilation openings. If the viewer is at a perspective that is spaced away from nearly normal to the panel plane, the edges of the slot cut off a direct line of sight to the ventilation openings.

In FIG. 10, the entry portions 122 effectively interrupt any line of sight 140 to ventilation openings 66 on the more acutely angled inner portion 132 of the side walls. A line of sight can be oriented substantially normal to the plane of the soffit but is incident on the bottom 64 of the channel. The bottom wall of the channel, the angle of the side wall and the depth of the entry portions are arranged such that there is no line of sight originating outside of the channel that can be incident on either sidewall. This effect is achieved because an extension or projection 140 of the angle a along the surface of the ventilating hole sidewall 132 (the projection 140 being shown by a broken line in FIG. 10) intersects the entry portion 122 on the opposite side of the channel, at a point at or above the junction of the slot at the exposed plane webs 68 of the ventilation component 123. Regardless of where the viewer's line of sight originates, the edges of the slot occlude the ventilation holes.

Although the ventilation openings 66 in FIG. 10 are wholly concealed, it is also possible as in FIG. 9 to conceal the ventilation openings from most perspectives. This can be achieved relatively effectively by providing a dovetail or flaring cross section in which the side walls of the channel diverge at least somewhat, proceeding into the channel as shown, that is, by providing an angle a that is an acute angle of less than 90°. Although less effective at concealing ventilation openings in the side walls, the angle a can be obtuse, but advantageously is near or equal to a right angle, and preferably is sufficiently acute at least substantially to foreshorten the view of the respective side wall from a viewer's perspective, normally when the viewer is standing on the ground outside the building and looking up at the eaves.

Issues associated with concealing the ventilation openings must be considered together with the intended aspect of allowing a relatively free flow of ventilation air. In the embodiments shown, the elongated slots 57 at the openings to the channels 55 define one point along the flow path of ventilation air at which the cross sectional area of the flow path is relatively more narrow than other points. The ventilation openings 66 through the channels walls are another point of constriction. Preferably, however, and as illustrated in FIG. 3, the ventilation openings are arranged and dimensioned so that the sum of cross sectional areas of the respective ventilation openings 66 is at least as large as the cross sectional area of an associated part of the elongated slot. Sufficient space for such ventilation openings can be achieved by making the side walls providing ventilation openings relatively large, thereby providing space for large openings 66. Alternatively, the side walls can each have an area approximately equal to the area of the elongated slot 57, and spaced openings in each opposite side wall can occupy about half the area of that side wall.

Advantageously, and as shown in FIG. 3, the total of the cross sectional areas of the ventilation openings 66 sums to an area that is somewhat greater than the area of the slot 57 over the same length of channel 55. Thus, the ventilation flow restriction produced by the ventilation openings 66 is not substantial because the size of the flow path is not reduced between the slot 57 and the openings 66.

There are a number of specific materials and manufacturing techniques possible for manufacturing the soffit. A malleable sheet metal web such as aluminum or clad aluminum sheet, or a not-yet-set polymer web, can be shaped by bending at intervals, for example by passing the material through one or more sets of contoured rollers rotating on an axis parallel to the elongation of the elongated slots, so as to insert the required folds. It is possible to extrude a panel in the contour shown, in metal or polymer material, such extrusion proceeding along a direction parallel to the elongation of the slots. The panels also can be injection molded polymer, or a combination of materials.

Figure 11:
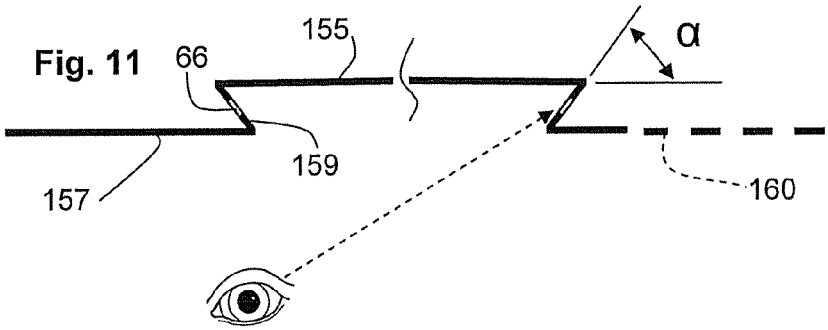
FIG. 11 is a schematic section view showing the applicability of the invention to components having plural levels connected by an perforate portion disposed at an acute angle relative to the levels.

The invention is applicable to various building components and other applications that benefit from passing flow through a curtain plane such as the plane of a soffit, while generally de-emphasizing the presentation of perforations, slots, louvers or the like. As described to this point, the invention has been exemplified by structures in which ventilation openings 66 are provided but in closely spaced side walls 62 of a relatively narrow channel 55. However, some of the advantages of the invention can be gained in an arrangement where instead of having two opposite channel side walls 62 that are closely spaced, the ventilation openings 62 are provided in single walls between webs of sheet material at different terrace levels. This embodiment is shown in FIG. 11. The sheet has an upper level 155, a lower level 157 that can be parallel to the upper one, and a connecting web 159 that extends integrally between the two levels. The connecting web 159 contains ventilation openings 66 and is arranged at an acute angle a as described above, so as to conceal the openings 66 at least from a view normal to the curtain plane 160.

Figure 20:
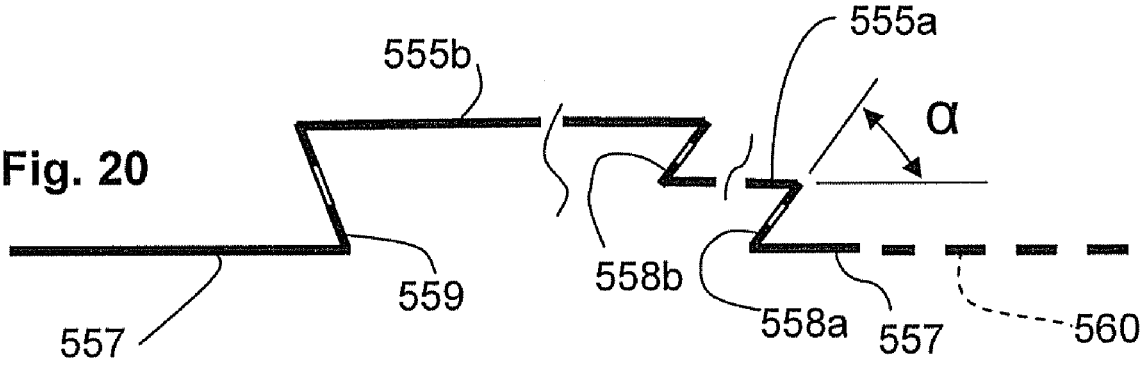
FIG. 20 is a section view of a soffit panel having terrace levels.

In FIG. 11, two connecting webs 159 are shown and are inclined oppositely, whereby each end of the component portion as depicted is a the lower or curtain plane level 160. However, the two webs 159 can be placed at an indefinite length, and as a practical matter can function individually to provide concealed ventilation openings because in each case the connecting web 159 is at an acute angle relative to the terrace levels 155, 157. By providing successive connecting webs 558*a*, 558*b* that are inclined in the same direction, the terrace levels can become progressively higher or lower (as shown in FIG. 20). By providing some connecting webs inclined in one direction and others inclined oppositely, the terrace levels can form an alternating stepped structure between upper and lower terrace levels as shown, or can provide other terraced shapes.

The terrace portions 155, 157 of the sheet material in this embodiment are parallel to one another and to plane 160, and are spaced equally (i.e., each web 159 having ventilation openings is equal in size). The terrace portions 155, 157 need not all be parallel to one another or plane 160. As shown in FIG. 20, the connecting webs 558*a*, 558*b*, 559 can be of different sizes, e.g., with two successive webs 558*a*, 558*b* inclined in one direction defining two terrace steps 555*a*, 555*b* and a double size web 559 in the opposite direction bringing the next terrace level 557 back down to the curtain plane 560. Any number of similar variations are possible, and the invention is not limited to the bi-level terraced configuration shown in FIG. 11.

The sheet material has one or more connecting webs 159, namely sheet walls extending integrally between and connecting the edges of the terrace web portions 155, 157 at the at least two levels. At least one and preferably all of the connecting web walls 159 have through openings 66 that permit ventilation through the panel. The two panel levels 155, 157 are arranged to overlap one another slightly, which causes the connecting web wall 159 that has the through openings to be inclined relative to the curtain plane 160. The inclination is at an acute angle, whereby the ventilation openings 66 are substantially concealed.

The soffit panel as shown in FIG. 11 can be considered to have a channel arrangement as in FIG. 6, but with different relative sizes compared to the channel bottoms 64 versus intermediate plane webs 68 in FIG. 6. In the case of successive connecting webs 159 inclined in alternating directions, one can identify either upwardly opening or downwardly opening channels by selecting the lower or upper terrace level as forming the "bottom" of the identified channel. Nevertheless, the soffit panel has successively spaced connecting web walls 159 joined to the two levels, forming said acute angle a with each level, whereby substantial ventilation flow path area is provided yet the openings 66 are concealed from a normal view.

In the foregoing embodiments, the ventilation openings are concealed by placement in acutely inclined connecting webs wherein the connecting web wall joins to the two terrace levels 155 or 157 at equal acute angles of at least about 30° and less than about 70°. These particular angles are preferred but are not intended to exclude arrangements having entry necks or passages as in FIG. 10, or channels that otherwise have different shapes or more or fewer fold lines than embodiments already shown and described.

Figure 13:
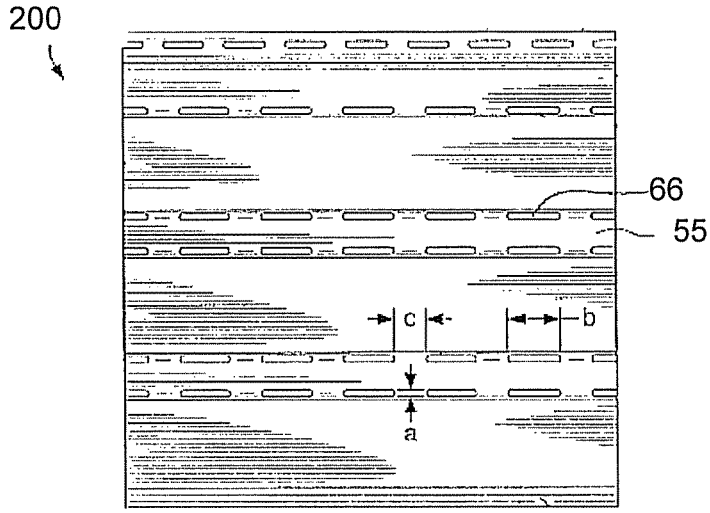
FIG. 13 is plan view showing a soffit panel having the configuration shown in FIG. 12.
Figure 12:
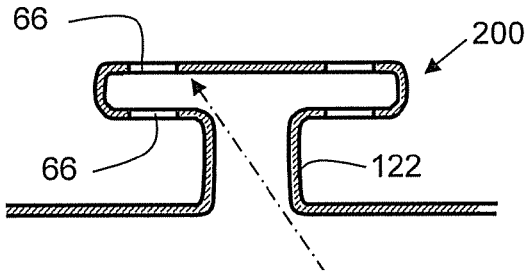
FIG. 12 is a partial section view showing the configuration of an alternative embodiment.
Figure 14:
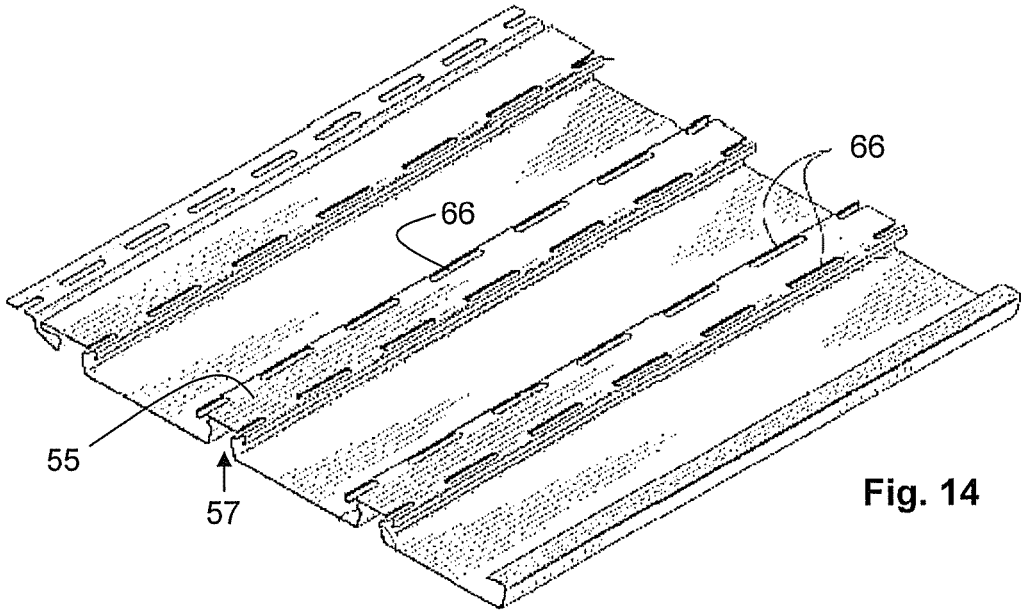
FIG. 14 is a perspective view showing the panel of FIG. 13.

FIGS. 12-14 illustrate an alternative embodiment 200 having a somewhat different shape for the ventilating channels. As best seen in FIG. 12, the side wall neck part 122 is continued into a laterally outwardly extending bend that continues into the top part (the "bottom" 55 of the channel opening at slot 57, shown in FIG. 14). In this case, the openings 66 can be provided both in the side wall portion adjacent to the neck part 122 and also in the top part as shown. The dash-dot arrow in FIG. 12 shows that the openings 66 are beyond a line of sight into the channel.

In this embodiment, the channel is substantially shaped as a hollow "T" in cross section, with the "T" structure opening in a panel having at least one panel section at a longitudinal recess. The recess has a first channel portion at slot 57, i.e., adjacent to the panel section, and a second channel portion, namely at the top of the "T," adjacent to the first channel portion. The second channel portion has a pair of edge portions at opposite ends of the second channel portion from each other. The second channel portion is wider than a width of the first channel portion at an end of said first channel portion distal from the panel, thus forming the "T." The edge portions include a plurality of openings. Each edge portion has an upper and lower segment and a connecting segment which connects the upper and lower segments of the respective edge portion. The plurality of openings 66 are disposed on one or both of the upper and lower segments of the edge portions. In the embodiment of FIGS. 12-14, the openings are provided in both the upper and lower segments. In the embodiments of FIGS. 15-18, the openings pass around the ends of the top bar of the "T" shape, i.e., on the connecting segment of the edge portion joining the upper and lower segments.

FIGS. 13 and 14 respectively show plan and perspective views. The openings 66 in this configuration are formed as rounded-end slots. Referring to FIG. 13, the slot width a, the slot length b and the slot spacing c, and additionally the inclusion in this embodiment of two slots or openings 66 on each lateral side, determine the cross sectional area of the flow path available for air flow through the soffit panel per unit of area of the soffit panel. Preferably, the total cross sectional air flow path through openings 66 is large in comparison with the cross sectional area leading into slot 57, e.g., at least half the area of slot 57, preferably of at least equal area, and optionally of greater area than that of slot 57.

In one embodiment, the openings 66 are approximately 0.125 inch in width, between about 1.0 to 1.3 inches in length, and between about 0.75 and 1.0 inch apart. In another embodiment, the openings 66 are between about 1.2 to 1.3 inches in length, about 0.13 to 0.14 inch in width, and between about 0.7 to 0.8 inch apart. The openings can be molded in an injection molding technique. Alternatively the openings can be formed as part of a perforation wheel process, optionally associated with forming the segments of the slot structure. A blade cutting process or a router process can also be used to form the openings.

Figure 15:
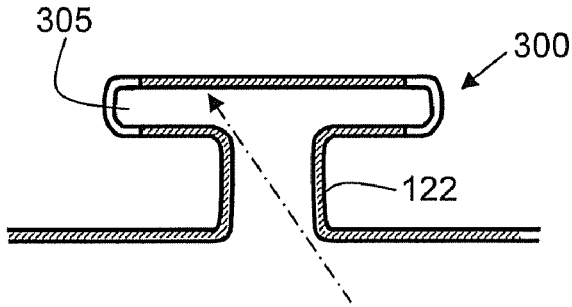
FIG. 15 is a partial section view showing the configuration of a further alternative embodiment wherein the openings are disposed laterally.
Figure 16:
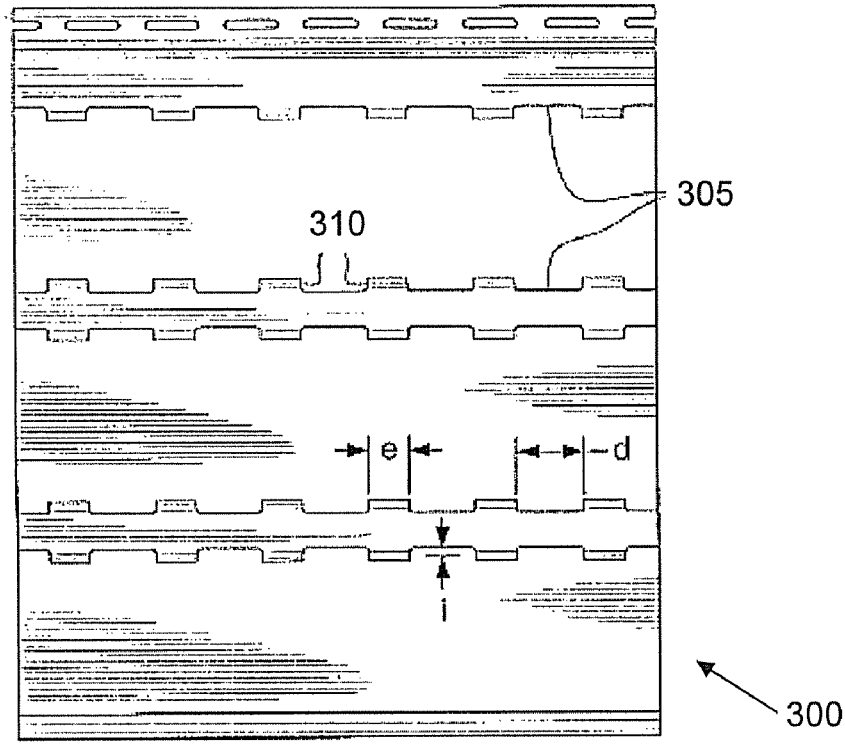
FIG. 16 is plan view showing a soffit panel having the configuration shown in FIG. 15.
Figure 17:
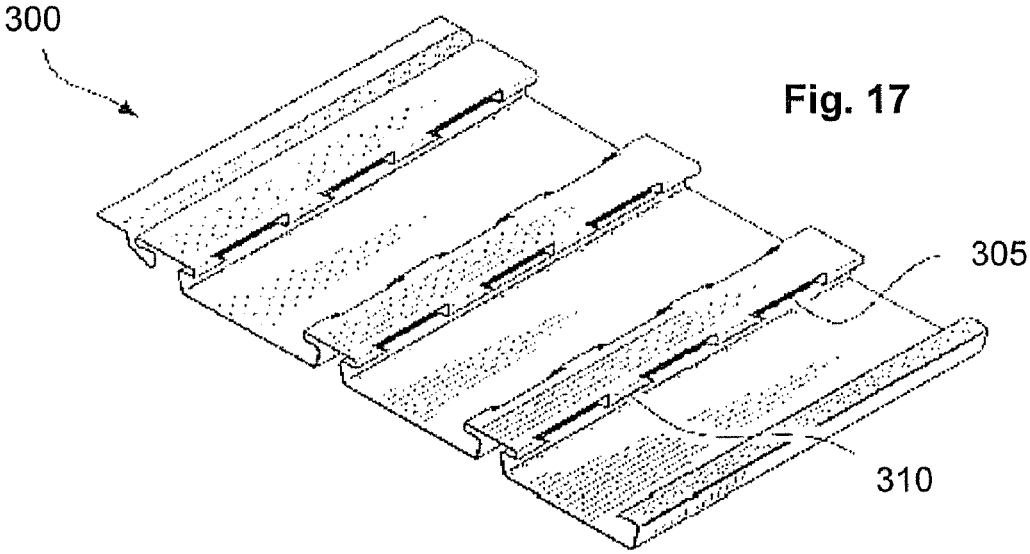
FIG. 17 is a perspective view showing the panel of FIG. 13.

The area available for openings 66 can be made larger, preferably while remaining out of the line of sight, by expanding the width a of the slots. FIGS. 15-17 illustrate an embodiment 300 wherein the openings are continued around the lateral turn of the cross section to form one lateral opening 305 in lieu of upper and lower openings 66. The openings 305 are separated by connecting webs 310 that provide the structural connection between the respective parts of the channels. Referring to FIG. 16, the cross sectional area available for flow is determined by choice of the cutout dimensions and placement including the lateral indent depth 1, the indent length d and the spacing e between indents. As in the previous embodiments, the total area available for flow through the cutouts or indents is preferable comparable to or larger than the cross sectional area leading into the slots.

Figure 18:
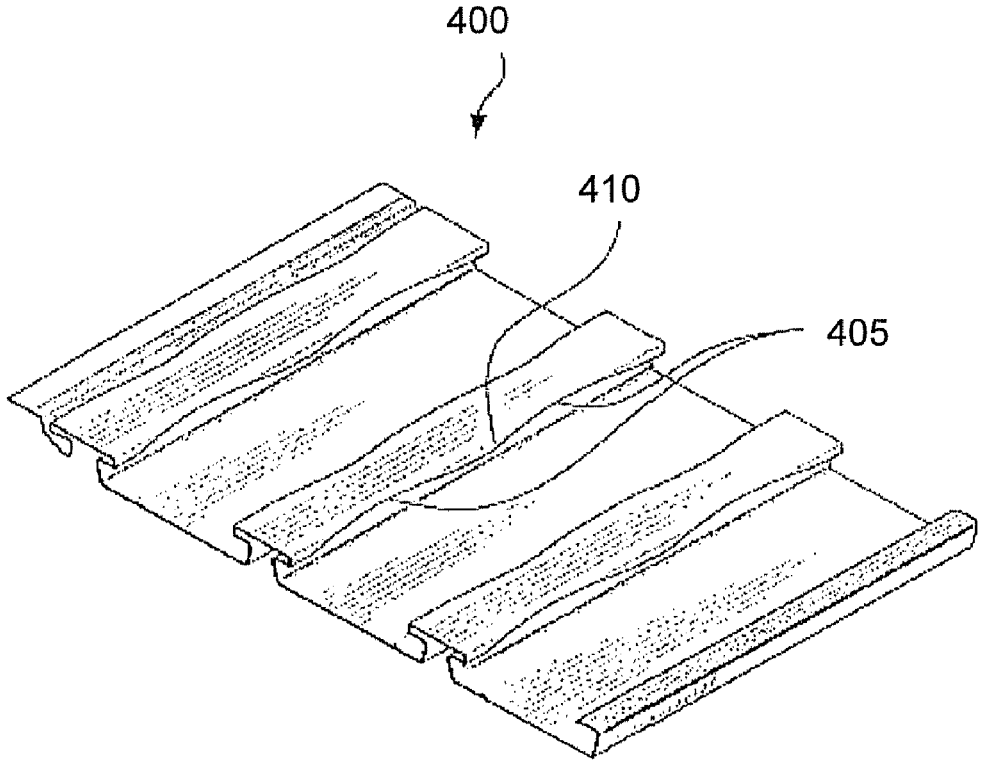
FIG. 18 is a perspective view of another alternative embodiment with lateral openings.

In the foregoing embodiments, the openings are arranged as slots with generally parallel sides, FIG. 18 illustrates an embodiment in which the opening width varies in a curve. Other specific arrangements of opening size, shape and position are possible in accordance with the invention.

Figure 19:
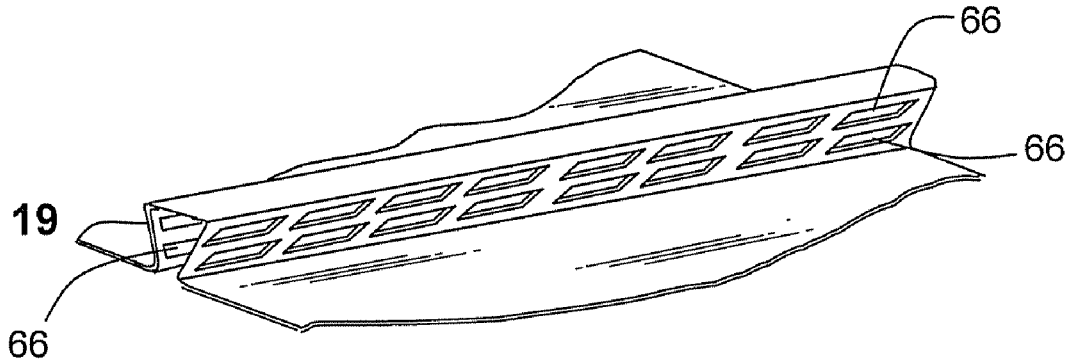
FIG. 19 is a partial perspective showing an alternative embodiment with dual rows of slots in both opposite walls defining a channel.

FIG. 19 illustrates an embodiment having openings 66 in the form of a dual row of slots on each side of the channel portion. This arrangement provides a given cross sectional flow area using slots that are individually smaller than those of the preceding arrangements of single slot rows. Small slots are advantageous for discouraging passage of certain insects.

As in the previous embodiments, the openings 66 are substantially hidden. In this embodiment, the slots are in registered parallel rows (the slots can be staggered instead). Each slot advantageously can be between 0.128 and 0.140 inch in width and 0.5 inches in length. The rows are laterally spaced about 0.125 inch from the edge of the openings in one row to the edge of the openings in the adjacent row. Within a given row, the slots are spaced endwise about 0.25 inch apart. This arrangement provides a very low obstruction to ventilation air in a soffit construction that externally presents only the elongated slot opening into the channel.

The invention has been disclosed in connection with certain examples and embodiments but is not limited to the particular constructions herein disclosed and shown in the drawings, but also comprises any modifications or equivalents within the scope of the appended claims.

What is claimed is:

1. A ventilating component for a building structure, comprising:

a panel comprising a planar sheet material extending over a coverage area;

a channel formed in the sheet material, the channel opening having at least one elongated slot facing one side of the panel and having spaced, straight channel side walls and a channel bottom projecting at an opposite side of the panel;

wherein the channel has at least one ventilation opening, the ventilation opening being concealed behind the slot from view from said one side of the panel, planar portions of the panel extending on each side of channel are parallel to the plane, the channel bottom is parallel to the portions extending on each side of channel, and the straight side walls of the channel each join integrally at an acute angle with said channel bottom and with an adjacent planar portion extending on each side of channel; and complementary opposite joint structures at opposite edges of the ventilating component, such that said ventilating component is attachable to another such ventilating component by engaging respective complementary opposite joint structures thereof, wherein the complementary opposite joint structures include joint walls that are inclined away from a joint gap, and wherein the joint walls and the joint gap as assembled are placed and shaped substantially to resemble the channel.

2. The ventilating component of claim 1, wherein the channel has an array of regularly spaced ventilation openings.

3. The ventilating component of claim 2, wherein the ventilation openings are disposed in at least one of the spaced channel side walls, and wherein the channel bottom is substantially continuous.

4. The ventilating component of claim 3, wherein at least a part of at least one of said side walls containing said ventilation openings is inclined in a direction away from the elongated slot.

5. The ventilating component of claim 3, wherein the spaced channel side walls both contain said ventilation openings and wherein the spaced channel side walls are inclined away from one another and away from the slot.

6. The ventilating component of claim 5, wherein the panel generally defines a plane over the coverage area, and wherein a plurality of said channels having ventilation openings are regularly spaced over the coverage area.

7. The ventilating component of claim 1, wherein the sheet material comprises at least one of formed sheet metal, extruded sheet metal, molded polymer, extruded polymer and a combination thereof.

* * * * *